US006910360B2

(12) United States Patent
Stjepan et al.

(10) Patent No.: US 6,910,360 B2
(45) Date of Patent: Jun. 28, 2005

(54) MULTIPLE WIRE FEED FOR SPRING COILING MACHINE AND METHOD

(75) Inventors: Hresc Stjepan, Prelog (HR); Gecic Josip, Koprivnica (HR); Duras Branko, Varazdinske Toplice (HR)

(73) Assignee: L&P Property Management Company, South Gate, CA (US)

( * ) Notice: Subject to any disclaimer, the term of this patent is extended or adjusted under 35 U.S.C. 154(b) by 357 days.

(21) Appl. No.: 10/004,189

(22) Filed: Oct. 23, 2001

(65) Prior Publication Data

US 2003/0074944 A1 Apr. 24, 2003

(51) Int. Cl.[7] ..... B21F 3/02

(52) U.S. Cl. ..... 72/140; 140/3 CA; 226/110; 226/109

(58) Field of Search ..... 72/133, 135, 140, 72/228, 428; 140/3 CA; 226/18, 109, 110

(56) References Cited

U.S. PATENT DOCUMENTS

| | | | | | |
|---|---|---|---|---|---|
| 1,908,884 | A | * | 5/1933 | Burd et al. | 72/140 |
| 2,119,002 | A | * | 5/1938 | Bergevin et al. | 72/132 |
| 2,944,755 | A | * | 7/1960 | Foster | 242/615.1 |
| 4,043,494 | A | * | 8/1977 | Bickford et al. | 226/109 |
| 4,112,721 | A | | 9/1978 | Takase et al. | |
| 5,131,251 | A | * | 7/1992 | Jacobson | 72/140 |
| 5,243,746 | A | | 9/1993 | Shinichi | |
| 5,713,115 | A | * | 2/1998 | Knoepfel et al. | 140/103 |
| 6,006,572 | A | * | 12/1999 | Tsuritani | 72/135 |
| 6,045,023 | A | * | 4/2000 | Michard | 226/110 |
| 6,186,440 | B1 | | 2/2001 | Yamakawa et al. | |
| 6,374,655 | B1 | * | 4/2002 | Hresc | 72/129 |

FOREIGN PATENT DOCUMENTS

| | | | | |
|---|---|---|---|---|
| JP | 08102354 A | * | 4/1996 | H01R/43/048 |

* cited by examiner

*Primary Examiner*—Allen Ostrager
*Assistant Examiner*—John S. Goetz
(74) *Attorney, Agent, or Firm*—Wood, Herron & Evans, L.L.P.

(57) ABSTRACT

An apparatus for making mattress and upholstery spring coils. The apparatus has a wire feeding device and a wire guide adapted to support first and second wires of different diameters. The wire guide is movable to first and second positions to align the first and second wires, respectively, with the wire feeding device. A spring coiling machine is positioned adjacent the wire feeding device. When the wire guide is in the first position, the spring coiling machine receives the first wire of one diameter from the wire feeding device; and the spring coiling machine bends the first wire into a spring coil of a desired diameter and pitch and having a first stiffness. When the wire guide is in the second position, the spring coiling machine receives the second wire of another diameter from the wire feeding device; and the spring coiling machine bends the second wire into a spring coil of the desired diameter and pitch but having a second stiffness.

12 Claims, 7 Drawing Sheets

MULTIPLE WIRE FEED FOR SPRING COILING MACHINE AND METHOD

FIELD OF THE INVENTION

This invention relates to spring coiling machines and, more particularly, to a multiple wire feed apparatus for a spring coiling machine.

BACKGROUND OF THE INVENTION

A continuing effort to more cost efficiently manufacture furniture of different kinds has led to continuous improvements in the production of spring coils. Further, there is a continuing effort to improve the quality and comfort of furniture in which spring coils are used, for example, seating cushions and mattresses. In particular, in order to support a human body in the proper posture when lying on a mattress, in many mattresses, it is desired to provide a mattress with spring coils at different locations having differing stiffness or spring constants to conform with the loading imposed by a human body.

In order to change the stiffness of a spring coil, a different diameter or gage wire is sometimes used to form the coil, for example, a thicker wire is used to make a stiffer coil and a thinner wire is used to make a less stiff coil. The tooling of known spring coiling machines is made to handle a specific wire diameter. Therefore, if it is desired to use a wire of a different diameter, the wire specific tooling of the spring coiling machine must be replaced with tooling made to handle wire of the different diameter. Obviously, the requirement of physically switching the tooling on a spring coiling machine so that it can work with a different size of wire is time consuming and expensive. Not only is there the added cost of skilled labor required to modify the spring coiling machine, but there is a significant cost in the production lost from the spring coiling machine while it is shut down for the tooling changeover. In addition, the further cost to manufacture and store different sets of wire specific tooling is also burdensome.

It is known to be able to automatically and continuously manufacture spring coils of different diameter and pitch from the same wire, thereby providing spring coils of differing stiffness or spring constants. However, the limitation of making spring coils from only a single wire severely limits the range of spring coil stiffness that can be provided. Further, the end product, for example, a mattress, is a fixed size and is normally designed to use a predetermined number of spring coils. Changing the diameter of selected spring coils to change the coil stiffness causes the number of spring coils used in the mattress to also change. Adding another variable, that is, the number of spring coils, substantially complicates the mattress design and manufacturing processes; and therefore, in the production of mattresses and other seating furniture, it is not practical to change spring coil stiffness by changing the spring coil diameter.

Consequently, there is a need for a spring coiling machine having a wire feed that permits coil springs to be automatically and continuously manufactured from different sizes of wire.

SUMMARY OF THE INVENTION

The present invention provides a simple and reliable apparatus for automatically and rapidly changing wires and tool settings to an input of a spring coiling machine. The apparatus of the present invention uses the same tooling on a spring coiling machine to make spring coils using different diameters of wires. Further, the apparatus of the present invention is able to automatically selectively feed wires of different diameters sizes to a spring coiling machine, thereby saving on the need for manual labor to change tooling. The apparatus of the present invention is especially useful in making spring coils for furniture, such as mattresses and seating furniture, in which spring coils of a common diameter but differing stiffnesses are often used. By providing for the automatic and continuous manufacture of constant diameter spring coils from wires of different sizes, the multiple wire feed apparatus permits such furniture to be made more quickly and at a substantially reduced cost.

According to the principles of the present invention and in accordance with the preferred embodiments, the invention provides an apparatus for making mattress and upholstery spring coils. The apparatus has a powered wire feeding device and a wire guide adapted to support first and second wires of different diameters. The wire guide is located on an input side of the wire feeding device and is movable to first and second positions to align the first and second wires, respectively, with the wire feeding device. A spring coiling machine is positioned adjacent an output side of the wire feeding device. When the wire guide is in the first position, the spring coiling machine receives the first wire of one diameter from the wire feeding device; and the spring coiling machine bends the first wire into a spring coil of a desired diameter and pitch and having a first stiffness. When the wire guide is in the second position, the spring coiling machine receives the second wire of another diameter from the wire feeding device; and the spring coiling machine bends the second wire into a spring coil of the desired diameter and pitch but having a second stiffness.

In another embodiment of the invention, a method is provided for making mattress and upholstery spring coils in which a plurality of wire paths are provided adjacent an inlet of a powered wire feeding device. The plurality of wire paths are moved to align one of the plurality of wire paths with an input side of the wire feeding device. The wire feeding device moves a first wire having a first diameter into a spring coiling machine, and the spring coiling machine is operated to make a first spring coil having a desired diameter and a first stiffness. The operation of the spring coiling machine and the wire feeding device is terminated, and the plurality of wire paths are moved to align another wire path with the wire feeding device. The wire feeding device moves a second wire having a second diameter into the spring coiling machine, and the spring coiling machine makes a second spring coil having the desired diameter and a second stiffness.

In one aspect of this invention, the spring coiling machine has a bending device; and after the spring coiling machine makes the first spring coil, the bending device is adjusted as a function of the diameter of the second wire.

These and other objects and advantages of the present invention will become more readily apparent during the following detailed description taken in conjunction with the drawings herein.

DETAILED DESCRIPTION OF THE INVENTION

Figure 1:
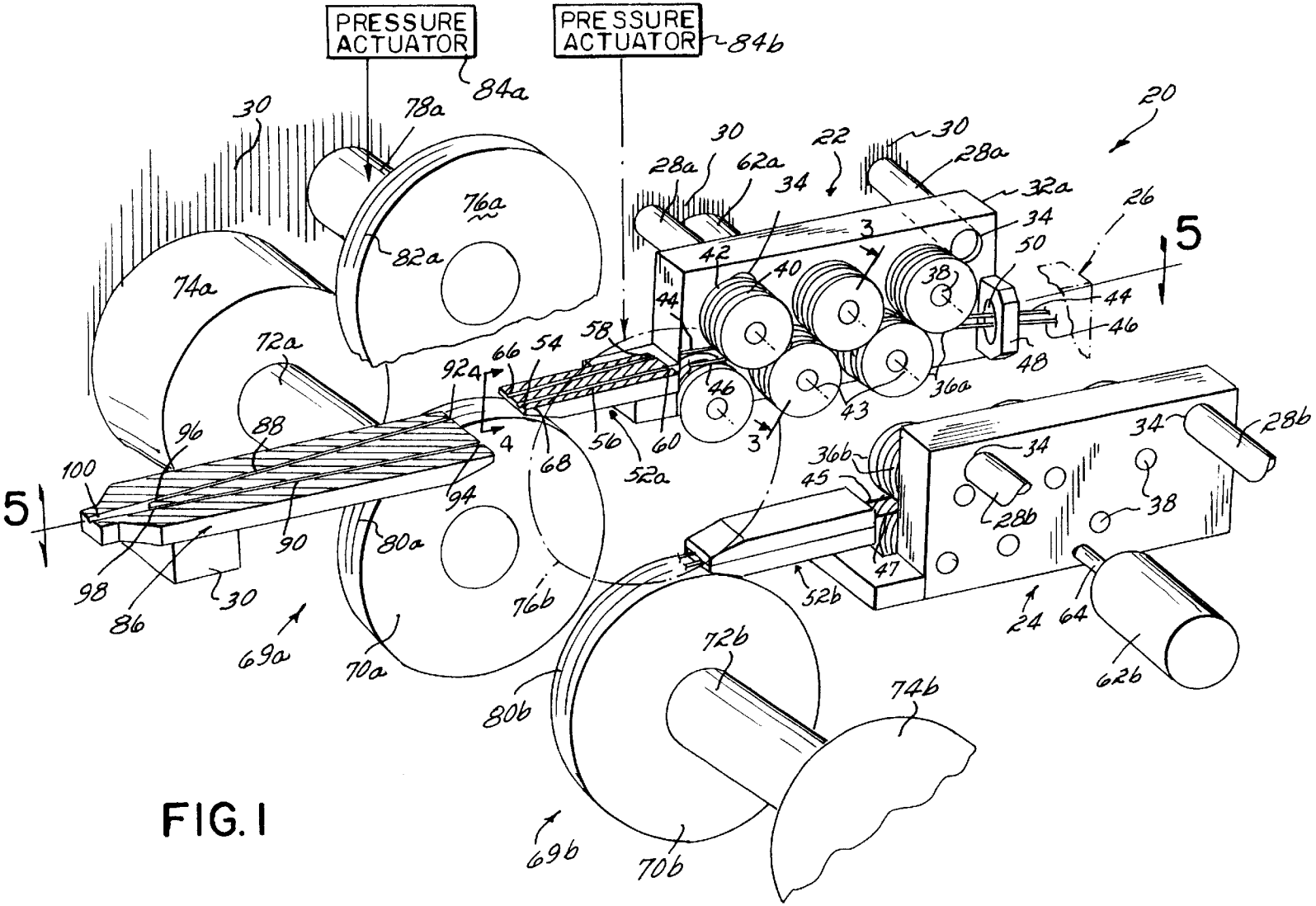
FIG. 1 is a schematic, perspective view of a four-wire feed apparatus in accordance with the principles of the present invention.
Figure 2:
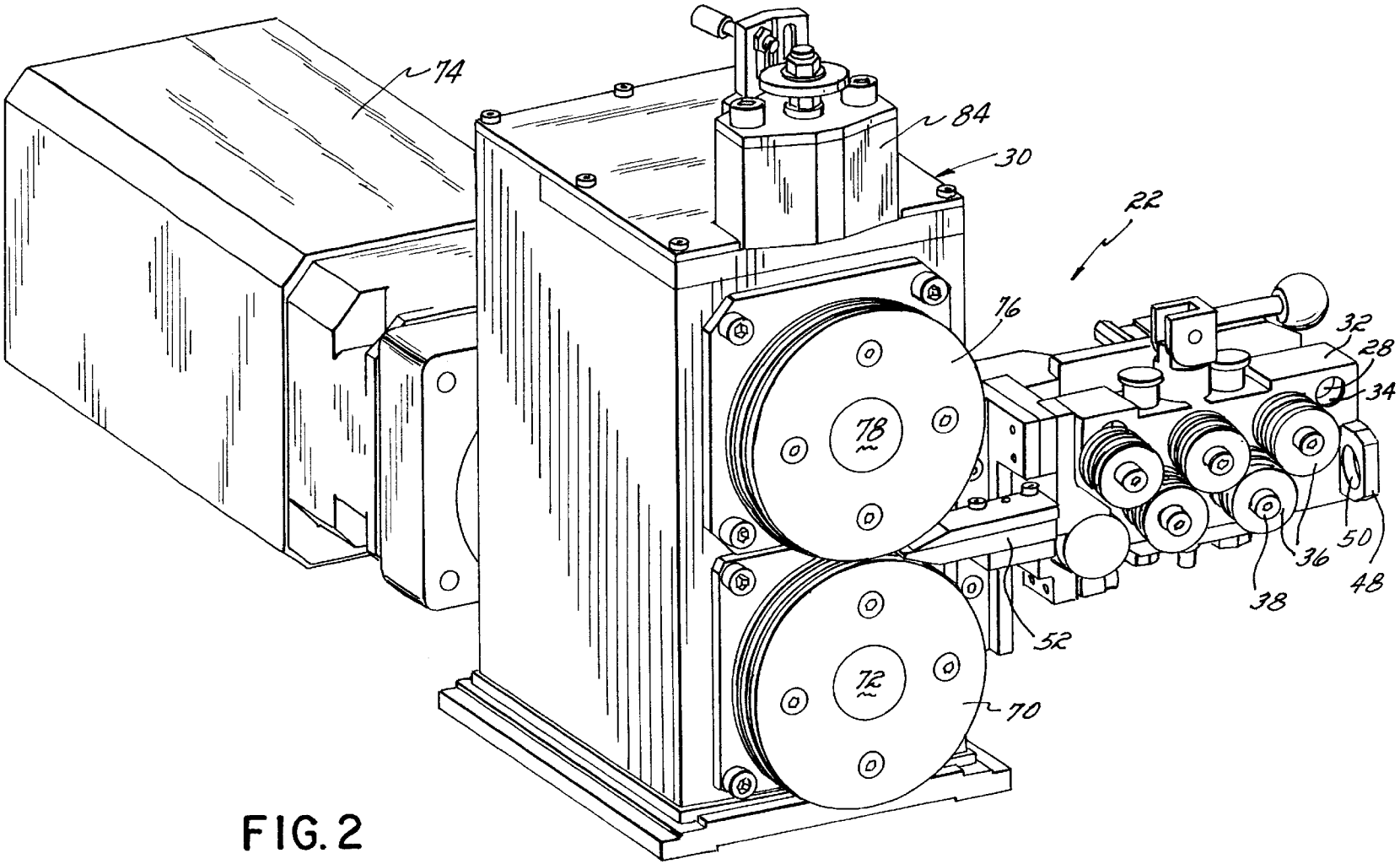
FIG. 2 is perspective view of a two-wire feed portion of the four-wire feed apparatus of FIG. 1.

Referring to FIGS. 1 and 2, a multiple wire feed apparatus 20 is comprised of a first multiple wire feeder 22 and a second multiple wire feeder 24. The second multiple wire feeder 24 is substantially a mirror image of the first multiple wire feeder 22. Thus, parts specific to the first multiple wire feeder 22 will be designated by a number with an "a" suffix, and commonly functioning parts specific to the second multiple wire feeder 24 will be designated by the same number with a "b" suffix. Further, to facilitate a better understanding of the structure and operation of the first multiple wire feeder 22, the second multiple feeder 24 is shown displaced or translated from its normal location. The normal location of the second multiple wire feeder 24 is illustrated by the phantom lines 26. Therefore, the first and second multiple wire feeders 22, 24, are normally disposed immediately adjacent each other as shown in FIGS. 5–8.

Figure 3:
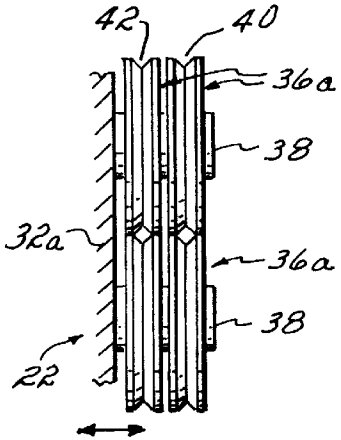
FIG. 3 is a view showing, in elevation, wire straightening rollers on the multiple wire feed apparatus taken along line 2—2 of FIG. 1.

The structure of the first multiple wire feeder 22 will be described in detail; and the explanation of the first multiple wire feeder 22 applies equally to the second multiple wire feeder 24. The first multiple wire feeder 22 has a pair of guide bars 28 that are rigidly connected to a supporting structure 30. A carriage 32 has guide ways 34 that are shaped to receive the guide bars 28 such that the carriage 32 is supported by, and readily slides over, the guide bars 28. A plurality of pairs of wire straightening rollers 36 are rotatably mounted on respective axles 38; and the axles 38 are rigidly mounted to the carriage 32. Referring to FIG. 3, Each pair of wire straightening rollers 36 has grooves 40, 42. The cross-sectional profile of the grooves 40, 42 and the centerline spacing of the axles 38 are selected such that the grooves 40 provide a wire straightening function for a first wire 44 of a first diameter or gage, and the grooves 42 provide a wire straightening function for a second wire 46 of a different, second diameter. Prior to entering the wire straightening rollers 36, the different first and second wires 44, 46 are fed from a coil in a known manner and pass through an aperture 48 of a block 50 mounted at a rear end of the carriage 32.

As shown in FIGS. 1 and 2, a first wire guide block 52 is rigidly attached at a forward end of the carriage 32. The first wire guide block 52 has first and second grooves or wire paths 54, 56, respectively. The wire path 54 has a first end 58 positioned to receive the first wire 44 from the grooves 42 of the wire straightening pulleys 36. The wire path 56 has a first end 60 positioned to receive the wire 46 from the grooves 40 of the wire straightening rollers 36.

An actuator 62, for example, an electric solenoid, a fluid cylinder, a device that converts rotary motion into linear motion, etc., is rigidly connected to the supporting structure 30. The carriage 32 is mounted to a distal end of an operating element 64 of the actuator 62, for example, an armature, a cylinder rod, a rack, etc. Thus, the linear actuator 62 is operable to translate or reciprocate the carriage 32 and first wire guide block 52 in a direction generally parallel to centerlines 43 of the axles 38. The carriage 32 and first wire guide block 52 are reciprocated in order to align one of the second ends 66, 68 of the respective wire paths 54 or 56 with an input side of a powered wire feeding device 69.

Figure 4:
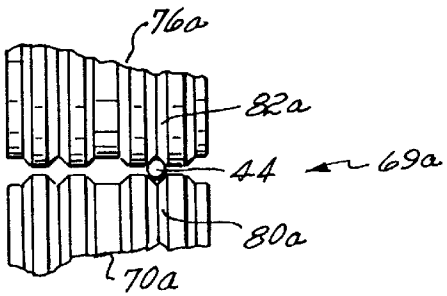
FIG. 4 is a view showing, in partial elevation, feed and pressure rollers on the multiple wire feed apparatus taken along line 3—3 of FIG. 1.

The wire feeding device 69 has a powered wire feed roller 70 that is connected to an output shaft 72 of a feed motor 74 that, in turn, is rigidly connected to supporting structure 30. A pressure roller 76 is rotatably mounted to the distal end of an axle 78 having a proximal end rigidly connected to the supporting structure 30. Referring to FIGS. 1 and 4, the feed roller 70 and pressure roller 76 have opposed respective grooves 80, 82 that are sized to accept a range of different wire diameters. A pressure actuator 84, for example, a fluid cylinder, or any other device for applying a force in a linear direction, is also rigidly mounted to the supporting structure 30. The pressure actuator 84 has a movable element, for example, a cylinder rod, that via a mechanical link or otherwise, applies a force on the axle 78 in response to an operation of the pressure actuator 84.

The feed and pressure rollers 70, 76 have respective grooves 80, 82 that having respective cross-sectional profiles adapted to receive coil wire. When the pressure actuator 84 is in a state in which little or no force is applied to the axle 78, the pressure roller 76 separates slightly from the feed roller 70; and thus, the groove 82 of the pressure roller 76 also separates from the groove 80 of the feed roller 70. The grooves 80, 82 separate by a distance sufficient to permit a wire, for example, a wire extending from an outer end 66, 68 of one of the grooves of the first wire guide block 52, to move laterally into or out of a location between the grooves 80, 82.

Figure 5:
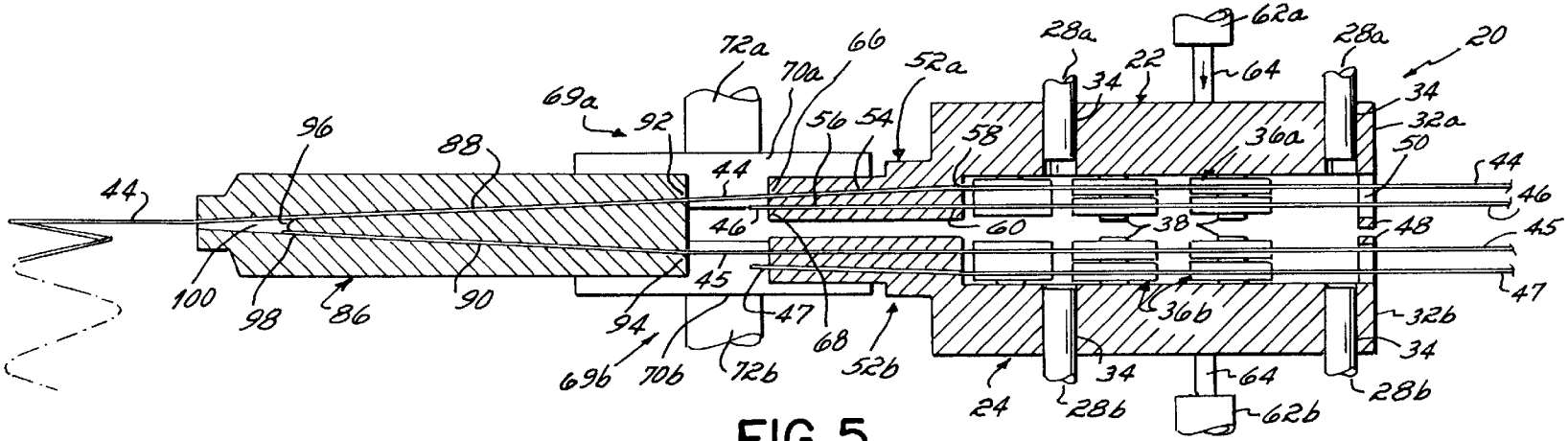
FIG. 5 is a schematic, partial cross-sectional view of the multiple wire feed apparatus of FIG. 1 feeding a first wire.

As shown in FIG. 5, the feed and pressure rollers 70, 76 are located such that a wire extending from the first wire guide block 52 can be positioned between the grooves 80, 82. Thus, when the actuator 84 applies a force against the axle 78, the pressure roller 76 moves closer to the feed roller 70; and the groove 82 presses the wire against the groove 80. The pressure actuator 84 causes the pressure roller 76 to apply a sufficient force against the wire between the grooves 80, 82, so that the feed roller 70 can pull the wire through the wire straightening rollers 36 and the first wire guide block 52. In some applications, the operation of the pressure actuator 84 may cause the applied force on the pressure roller 76 to vary in order to maintain a desired tension force on the wire passing between the grooves 80, 82.

A second wire guide block 86 is rigidly mounted to the supporting structure 30 adjacent output sides of the powered wire feeding devices 69*a*, 69*b* and has first and second grooves or wire paths 88, 90, respectively. The second guide block 86 is positioned such that a first end 92 of the first wire path 88 is positioned to receive a wire being fed from between the grooves 80, 82 of the respective feed and pressure rollers 70, 76. As shown in FIG. 5, a first end 94 of the wire path 90 is positioned to receive a wire being fed from a groove of feed roller 70*b*. The wire paths 88, 90 have respective second ends 96, 98 that intersect an outlet channel 100 of the second wire guide block 86. Thus, with the multiple wire feed apparatus 20 in the state illustrated in FIG. 5, the feed and pressure rollers 70*a*, 76*a* are operative to feed a first wire 44 of a first diameter through grooves 42 of wire straightening rollers 36, through wire path 54 of the first wire guide block 52, along guide path 88 of the second wire guide block 86 and out the outlet 100. The wire is then fed to a wire coiling machine illustrated in FIG. 9.

Figure 9:
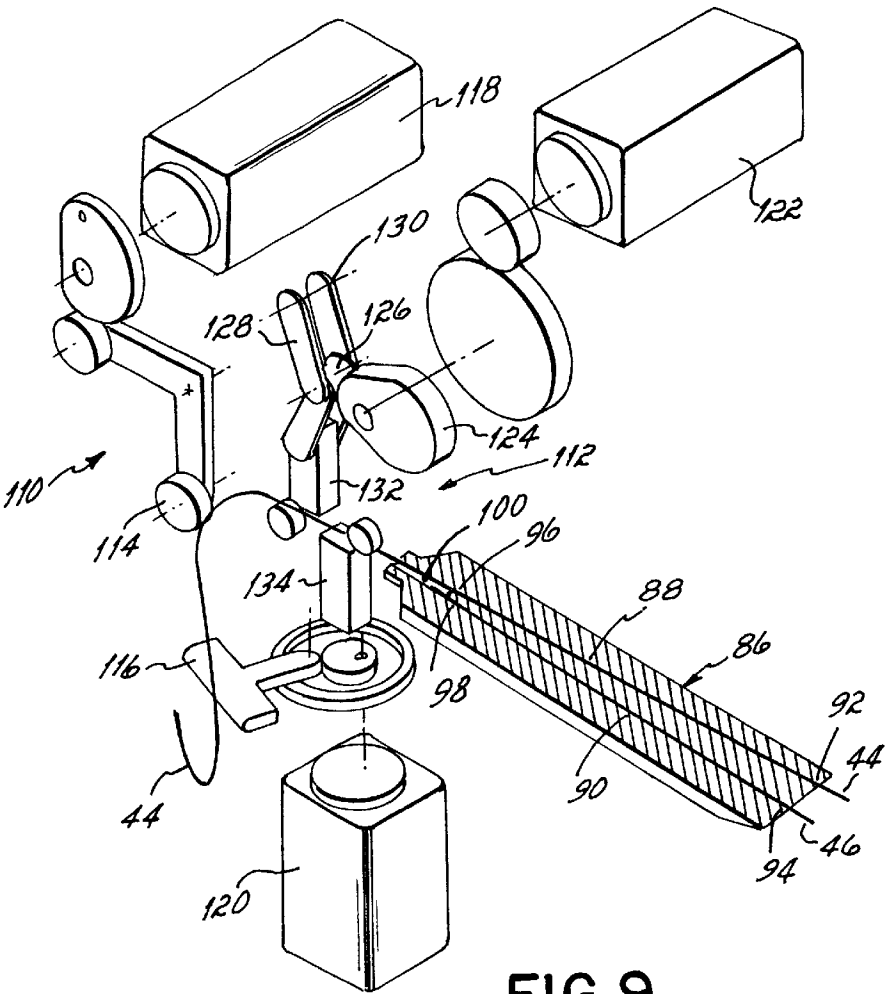
FIG. 9 is a schematic, perspective view of a spring coiling machine to which the multiple wire feed apparatus of FIG. 1 can be used.

The structure and operation of a spring coiling machine 110 of FIG. 9 is similar to that shown and described in U.S. Pat. No. 5,713,115 that is hereby incorporated by reference in its entirety herein. The spring coiling machine has a bending device 112 comprising essentially a bending tool implemented as a bending roller 114 and a pitching tool 116. The bending roller 114 is driven by a servo motor 118, and the pitching tool 116 is moved by a servo motor 120. A wire cutting action is provided by a servo motor 122 that rotates a cam 124. The outer circumference of the cam 124 contacts a roller 126 that is rotatably disposed at a pivotal portion of an articulated lever 128. The articulated lever 128 is pivotally supported at one end by a pivot axis 130. The opposite end is pivotally connected to an upper cutter 132 that is positioned in an opposing relationship with a stationary lower cutter 134. The servo motors 118, 120, 122 are operated in a manner such that the bending roller 114 and pitching tool 116 are effective to bend a wire 44 into a spring coil having a desired diameter and coil pitch. The servo motor 122 is then operated such that the wire is cut between the respective moving and stationary cutters 132, 134. The process is repeated to automatically form other coils from the wire 44 as it is fed to the spring coiling machine 110.

The actuators and motors of the multiple wire feed apparatus 20 and spring coiling machine 110 are controlled by a programmable controller 140 that is electrically connected to user input/output ("I/O") devices 142, for example, pushbuttons, keyboard, visual displays, lights, printer, etc. Using one or more of the I/O devices 142, a user is able to input a program identifying the basic specifications of a desired spring coil. The control 140 is electrically connected to a microcontroller 144 that is responsive to the desired spring coil specifications and provides outputs to various motor controllers 146 that control motors 118, 120, 122 on the spring coiling machine such that the desired spring coil is made. Feedback devices 148 provide feedback information to the motor controllers 146 to facilitate the control of the motors 118, 120, 122 in accordance with the commanded operation provided by the microcontroller 144. The microcontroller 144 also provides command signals to motor controllers 150 that are operative to operate motors 74*a*, 74*b* of the multiple wire feed apparatus 20 in order to initiate and terminate a wire feed at the appropriate times. Feedback devices 152 facilitate the control of the motors 74*a*, 74*b* by the motor controllers 150. A programmable logic controller 154 is also electrically connected to the programmable controller 140 and provides output signals to the actuators 84*a*, 84*b*, 62*a*, 62*b* of the multiple wire feed apparatus 20.

In use, when making spring coils for furniture, for example, mattresses, in order to support a human body in the proper posture when lying on a mattress, it is sometimes desirable to provide a mattress with spring coils at different locations having differing stiffnesses or spring constants to conform with the loading imposed by a human body. For example, a mattress may be divided into as many as five sections, a head section, an chest section, a waist section, a hip section and a leg section, wherein each section has spring coils of a specific and often different stiffness. Thus, in order to use spring coils of the same diameter, the spring coils for each section must be made with wire of a different size, that is, diameter. Using the example above, assume that the coils for the chest section are a medium stiffness, the coils for the hip section are a heavy stiffness and the coils for the head, waist and leg section are a light stiffness. The number of coils and their stiffness will vary depending on the mattress size, its target market, posture support profile, etc. Once designed, the number of coils to be made for each mattress section and the wire used is input and stored in the microcontroller 140. Further, the bender roller and pitch settings for each of the wire sizes for a spring coil diameter is also input and stored in the microcontroller 140 and/or the microprocessor 144.

To make spring coils for a mattress, the user first identifies or inputs either, a particular type of mattress or, the number of coils and wire size to be used for each mattress section. Upon initiating a cycle of operation, the microcontroller 140 causes the bending roller 114 and pitching tool 116 to be adjusted, so that a spring coil of a desired diameter will be made from a first wire size to provide a less stiff spring coil for the head section. The microcontroller 140 then commands the multiple wire feed apparatus of FIG. 1 to begin feeding the first wire to the spring coiling machine of FIG. 9. As each coil is made, the microcontroller 140 causes the motor 122 to cut the coil and release it from the coiling machine. Another machine assembles the spring coils in a known manner.

After a number of coils have been made so that the head section of the mattress is complete, the microcontroller 140 commands the multiple wire feed apparatus to switch to a second wire size, for example, a heavier wire to make stiffer spring coils for the chest section of the mattress. Simultaneously, the microprocessor 144 causes the bending roller 114 and pitching tool 116 to be adjusted, so that a spring coil of the desired diameter will be made from the second, heavier wire size. The microcontroller 144 causes the heavier wire feed to be initiated, and a desired number of stiffer spring coils for the chest section of the mattress are made. Thereafter, the microcontroller 140 causes the multiple wire feed apparatus 20 to switch to a third, lighter gage wire, so that a number of coils are made for the waist section that have a lighter stiffness. After adjusting the bending roller and the pitching tool for the smaller size wire, the process is repeated in order make lighter stiffness coils for the waist section of the mattress. The above process is repeated using a heavier gage wire for the hip section and a lighter gage wire for the leg section. Thus, the multiple wire feed apparatus 20 permits spring coils to be continuously made from different wire sizes or gages without manually changing tooling on the machine.

Figure 11:
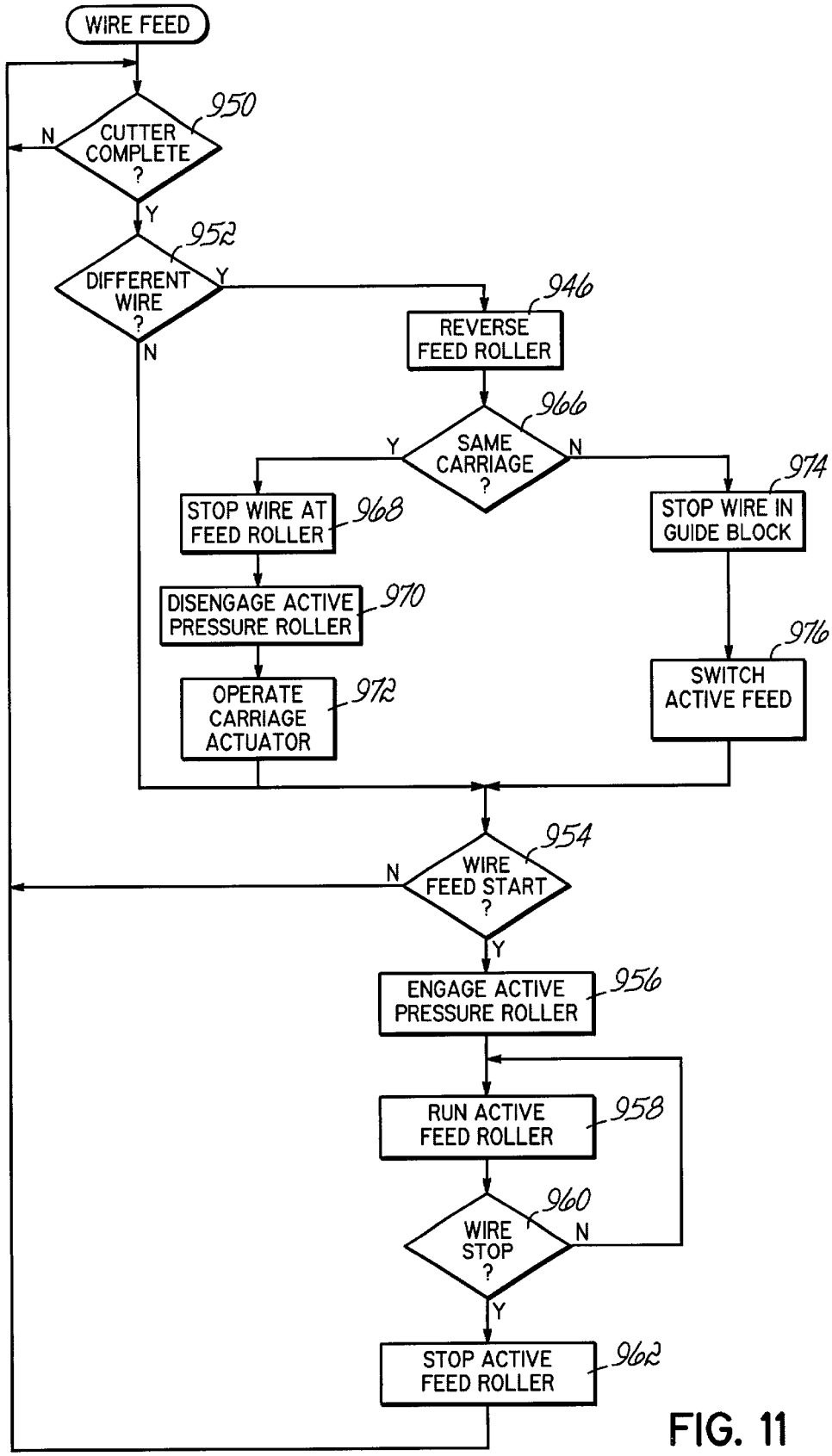
FIG. 11 is a flow chart of an operation of the multiple wire feed apparatus of FIG. 1.

The operation of the multiple wire feed apparatus is generally illustrated in FIG. 11. First, at 950, a determination is made whether the cutter 132 has completed its operation. If so, then at 952, the microcontroller 144 determines whether a new wire size is required. Assume that the spring coils are currently being made from the wire 44 and that a different wire size is not desired at this time. The PLC 154 then determines, at 954, whether a wire feed start command has been received. If so, the PLC proceeds, at 956, to engage the active pressure roller 76*a* by changing the state of an output signal to the actuator 84*a*. Changing the state of the actuator 84*a* causes pressure to be applied to the axle 78*a*, thereby moving the pressure roller 76*a* toward the feed roller 70*a* and engaging the wire 44 between the grooves 80, 82. The PLC 154 then provides a signal to the microcontroller 144 indicating that the pressure roller 76*a* is engaged.

Thereafter, at 958, the microcontroller 144 provides an output signal to the motor control 150 that causes the feed motor 74*a* to run. Upon operating the feed motor 74*a*, the wire 44 is pulled off its supply coil, through wire straightening rollers 36 and through the first wire feed guide block 52, and the wire 44 is pushed across the second wire guide block 86 into the spring coiling machine 110 of FIG. 9. The microcontroller 144 continues to operate the spring coiling machine 110 until a desired number of coils have been manufactured. It should be noted that in that process, the feed motor 74*a* may or may not be stopped during the operation of the wire cutter 132 as each spring coil is manufactured. If the feed motor 74*a* is stopped, a command is detected at 960, by motor controller 150 which, in turn, at 962, provides outputs to the motor 74*a* bringing it to the desired stopped state.

Figure 6:
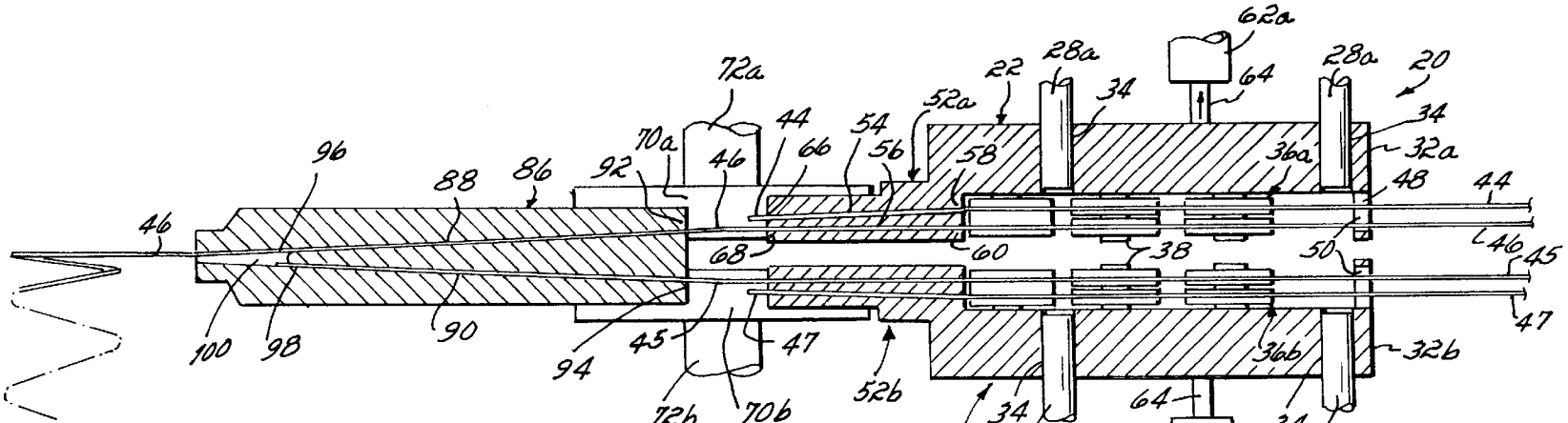
FIG. 6 is a schematic, partial cross-sectional view of the multiple wire feed apparatus of FIG. 1 feeding a second wire.

After a number of spring coils have been made from the wire 44, it may be desirable to manufacture a number of stiffer spring coils from a thicker wire, for example, wire 46. The microcontroller 144 then, at 964 of FIG. 11, provides a command to the motor controller 150 commanding the motor controller 150 to reverse the operation of the wire feed motor 74*a*. The end of the wire 44 is currently located at the wire cutter 132. By reversing the operation of the feed motor 74, the wire 44 is retracted from the wire cutter 132. Next, at 966, the microcontroller determines whether the next wire to be used is on the same carriage, for example, carriage 32*a*, or on another carriage, for example carriage 32*b*. The wires 44 and 46 are fed off of the same carriage, and therefore, the microcontroller 144 stops the reverse wire feed so that the end of the wire 44 is at the same position as the wire 46 in FIG. 5. Therefore, when the wire 44 reaches the position that is shown in FIG. 6., the motor controller 144, at 968, commands the wire feed motor 74*a* to stop. Further, at 970, the PLC 154 releases the active pressure roller 76*a* by commanding the actuator 84*a* to change states. Thereafter, at 970, the microcontroller 144 commands the PLC 154 to actuate the carriage actuator 62*a*. Since the wire 44 was initially being fed through the feed roller 76*a*, the actuator 62*a* was in its extended state as illustrated in FIG. 5. The PLC 154 operates the actuator 62, so that it moves to its retracted state as illustrated in FIG. 6, thereby moving the carriage 32*a* and first wire guide block 52*a* slightly upward as viewed in FIG. 6. That motion slides the cut end of the wire 44 from between the grooves 80, 82 of the respective feed and pressure rollers 70*a*, 70*b*. Further, the cut end of the wire 46 is moved to an inlet between the grooves 80, 82, thereby placing the wire 46 at a feed location.

After receiving a signal from the PLC 154 that the wire 46 is in the feed position, the microcontroller 144 then proceeds, at 954, to initiate a wire feed command. The PLC 154 first, at 956, engages the active pressure roller 76*a* and thereafter, at 958, operates the active feed roller 70*a* in a manner as previously described. The microcontroller 144 in addition operates the wire coiling machine 110 to produce a number of spring coils with the different sized wire 46. If the wire 46 has a thicker diameter, the spring coils made therefrom will be stiffer, feel firmer and provide more support for the user. If the wire 46 has a smaller diameter than the wire 44, the spring coils will be less stiff, feel softer and provide less support to the user. Thus, using the apparatus just described, spring coils for furniture can be automatically and continuously produced from different wire sizes in order to provide spring coils of differing thickness. Further, the diameter in pitch of spring coils made from each size wire may also be adjusted to provide further variations in stiffness.

As shown in FIG. 6, the multiple wire feed apparatus 20 has a second multiple wire feeder 24 that is substantially identical to, but a mirror image of, the first multiple wire feeder 22. The second multiple wire feeder 24 has a capability of providing two additional wires 45, 47, of different sizes, so that there is even greater flexibility in using the spring coiling machine 110 of FIG. 9. The wires 45, 47 pass through wire straightening rollers 36*b* and across a first wire guide block 52*b* along first and second wire paths 54*b*, 56*b*. As shown in FIGS. 1 and 6, the wire 45 passes through grooves 80*b*, 82*b* of the respective feed and pressure rollers 70*b*, 76*b* and along wire path 90 of the second wire guide block 86.

Figure 7:
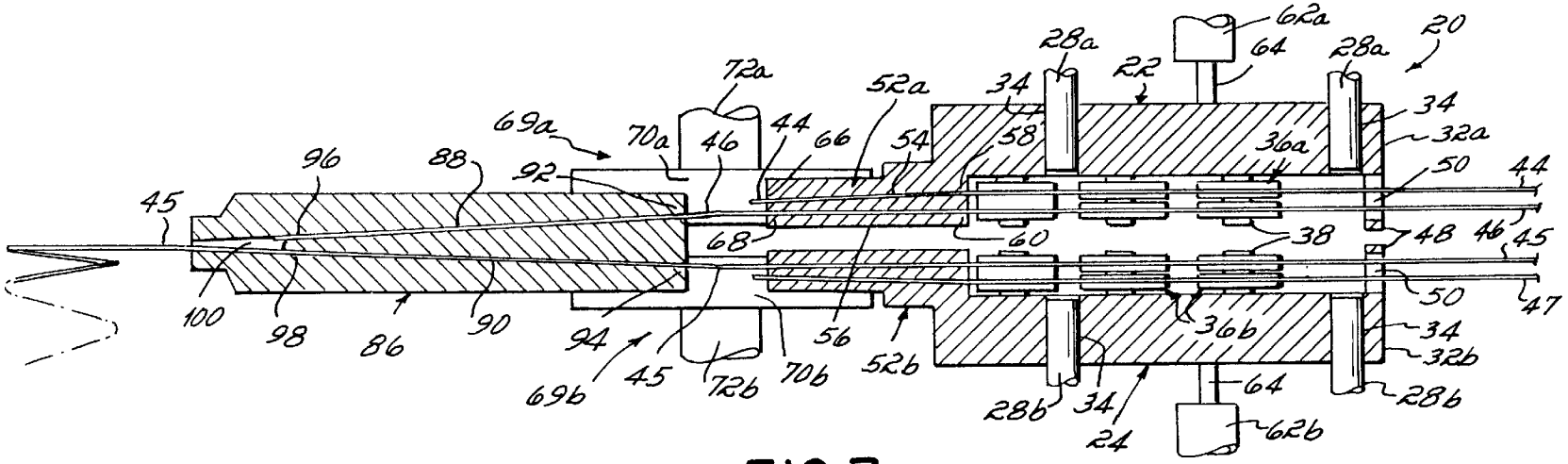
FIG. 7 is a schematic, partial cross-sectional view of the multiple wire feed apparatus of FIG. 1 feeding a third wire.

In switching from wire 46 to wire 45, the process of FIG. 11 is executed as previously described, however, at step 966, in retracting the wire 46, the microcontroller 144 determines that next wire to be used, wire 45, is not on the same carriage 32*a* as the currently active wire 46. Therefore, the microcontroller 144 stops the reverse wire feed of the wire 46, so that the end of wire 46 is at the same position as the wire 45 in FIG. 6. Therefore, when the wire 46 reaches the position that is shown in FIG. 7., the motor controller 144, at 974, commands the wire feed motor 74*a*to stop. Thereafter, the microcontroller 144, at 976, switches the active feed from feed and pressure rollers 70*a*, 76*a* to feed and pressure rollers 70*b*, 76*b*. Thereafter, at 956, when a wire feed command is detected, the microcontroller 144 provides a command to the PLC 154 to engage the active pressure roller.

The PLC 154 then switches the state of the pressure actuator 84*b*, thereby causing the pressure roller 76*b* to secure the wire 45 in the grooves 80*b*, 82*b* of the respective feed and pressure rollers 70*b*, 76*b*. Next, at 958, the microcontroller 144 runs the active feed roller by providing command signals to the motor controller 150*b* that, in turn, operates the active feed motor 74*b* in the forward direction. Thus, wire 45 is pulled from a feed coil, through wire straightening rollers 36*b* and along wire path 54*b* of the wire guide block 52*b*. Further, rotation of the active feed roller 70*b* pushes the wire 45 along wire path 90 of the second wire guide block 86 and into the spring coiling machine 110. Thus, a number of spring coils are made from wire 45 which is a different size than the wires 44 and 46.

Figure 8:
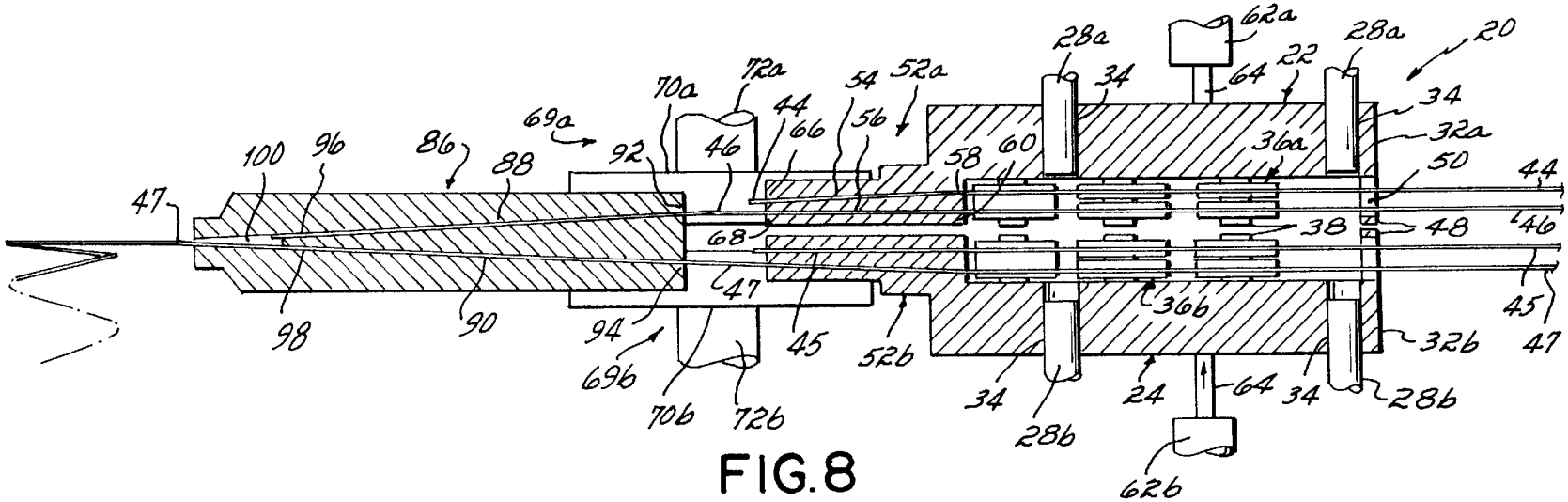
FIG. 8 is a schematic, partial cross-sectional view of the multiple wire feed apparatus of FIG. 1 feeding a fourth wire.

If a change in spring coil stiffness is again required, the second multiple wire feeder can be used to provide a fourth wire 47 of a different size from the wires 44, 45, 46. In a manner similar to that described with respect to the change from wire 44 to wire 46, since the wire 47 is on the same carriage 32*b* as the wire 45, the wire 45 is retracted to a position adjacent the feed roller 70*b* as shown in FIG. 8. The feed roller 70*b* is stopped, and the pressure roller 76*b* is disengaged. Next, the carriage actuator 62*b* is operated so that the wire 47 is moved into a feeding relationship with respect to the feed and pressure rollers 70*b*, 76*b*. As shown in FIG. 7, to engage wire 45 in a feeding relationship, the actuator 62*b* is retracted. Therefore, in order to feed the wire 47, the actuator 62*b* is extended, thereby moving or translating the carriage 32*b* and wire feed block 56*b* slightly upward to a position shown in FIG. 8. That motion moves the wire 45 out of, and moves the wire 47 into, the grooves 80*b*, 82*b* of the respective feed and pressure rollers 70*b*, 76*b*. Therefore, the next time the feed motor 74*b* is operated, the feed roller 70*b* is operative to pull the wire 47 through the wire straightening rollers 36*b* and across the wire path 56*b* of the first wire guide block 52*b*. Further, the feed roller 70*b* pushes the wire 47 along the wire path 90 of the second wire guide block 86 and into the spring coiling machine 110 of FIG. 9. Thus, spring coils are continuously made from the wire 47 which is a different wire size from the wires 44, 46, 45.

The multiple wire feed apparatus described herein provides a simple and reliable apparatus for automatically and rapidly changing wires to an input of a spring coiling machine. The multiple wire feed apparatus permits the use of the same tooling on a spring coiling machine to make spring coils using different sizes of wires. Further, the changing of wire sizes with the multiple wire feed apparatus is accomplished automatically without the need for manual labor. Thus, the multiple wire feed apparatus is especially useful in making spring coils for furniture such as mattresses and seating furniture in which coil springs of a common diameter but a differing stiffness are often desired. By providing for the automatic and continuous manufacture of spring coils from wires of different sizes, the multiple wire feed apparatus permits such furniture to be made more quickly and at a substantially reduced cost.

Figure 10:
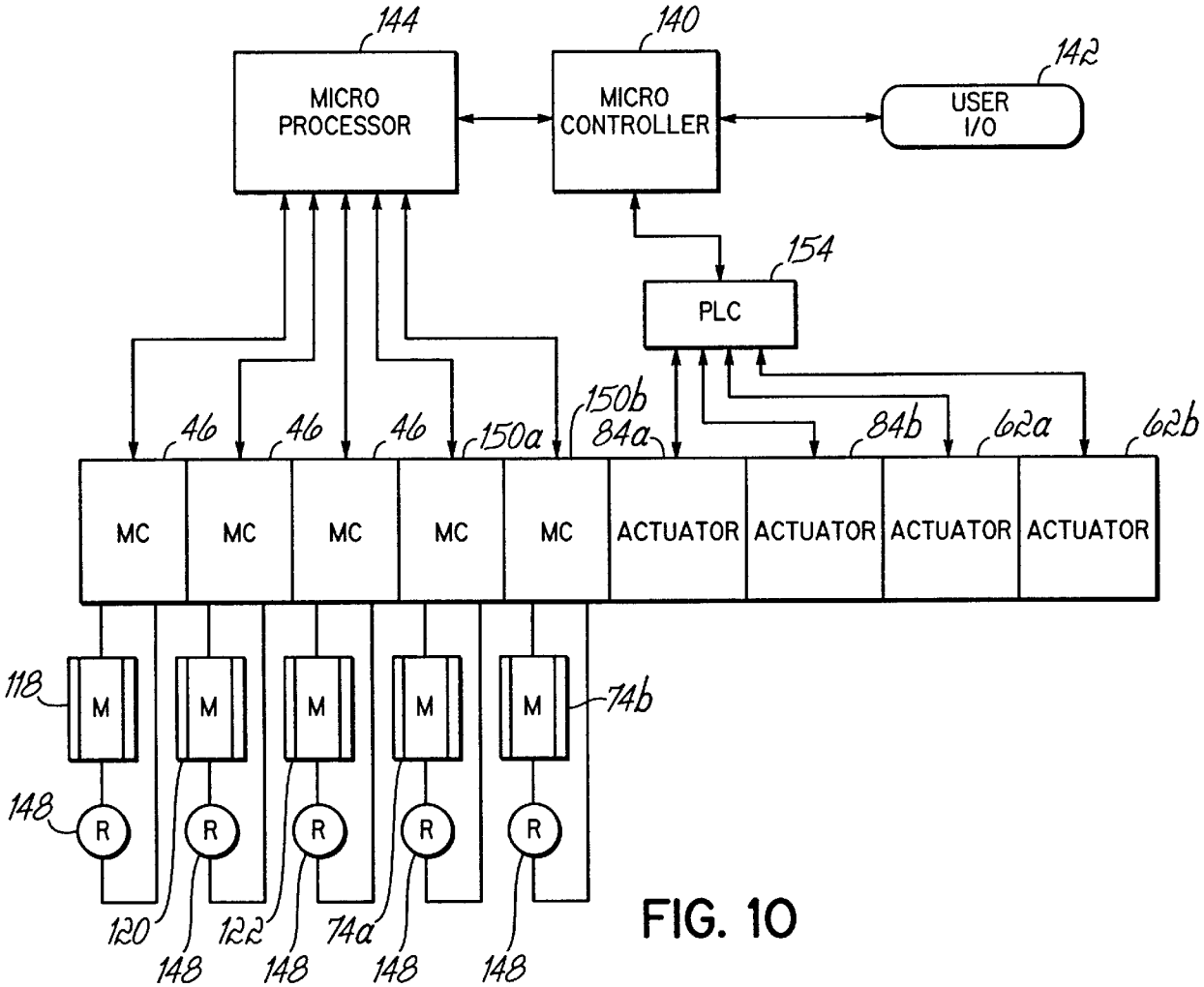
FIG. 10 is a schematic block diagram of a control for operating the multiple wire feed apparatus of FIG. 1.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, four wires 44, 45, 46, 47 are selectively used to make spring coils of differing stiffness. As will be appreciated, similar structure can be used to feed additional wires. Further, in FIG. 10, the PLC 154 is shown electrically connected to the microcontroller 140. As will be appreciated, depending on a desired control architecture, the PLC 154 can be electrically to either the microcontroller 140 or the microprocessor 144 or both of those devices.

Therefore, the invention in its broadest aspects is not limited to the specific details shown and described. Consequently, departures may be made from the details described herein without departing from the spirit and scope of the claims which follow.

What is claimed is:

1. An apparatus for making mattress and upholstery spring coils from first, second, third and fourth wires, the apparatus comprising:

first and second powered wire feeding devices having respective input sides and output sides;

a first wire guide disposed adjacent the input side of the first powered wire feeding device and simultaneously supporting the first and second wires;

a first actuator operatively connected to the first wire guide and being operable to move the first wire guide between first and second positions to align the first and second wires, respectively, with the first powered wire feed device;

a second wire guide disposed adjacent the input side of the second powered wire feeding device and simultaneously supporting the third and fourth wires;

a second actuator operatively connected to the second wire guide and being operable to move the second wire guide between first and second positions to align the third and fourth wires, respectively, with the second powered wire feed device;

a third wire guide disposed adjacent the output sides of the first and second powered wire feeding devices and adapted to receive wires being fed by the first and second powered wire feeding devices;

a spring coiling machine disposed adjacent the third wire guide and a programmable control connected to the powered first and second wire feeding devices, the first actuator, the second actuator and the spring coiling machine, the control being operable to cause one of the first, second, third and fourth wires to be fed to the spring coiling machine and further cause the spring coiling machine to form the one of the first, second, third and fourth wires into a spring coil of a desired coil diameter and pitch.

2. A method of making mattress and upholstery spring coils comprising:

(a) providing a first pair of wires simultaneously on a first wire guide adjacent an inlet of a first powered wire feeding device and a second pair of wires simultaneously on a second wire guide adjacent an inlet of a second powered wire feeding device;

(b) automatically moving one of the first and second wire guides to align one wire of the first and second pairs of wires with an inlet of one of the first and second powered wire feeding devices;

(c) automatically feeding the one wire through a third wire guide disposed adjacent respective output sides of the first powered wire feeding device and the second powered wire feeding device and into a spring coiling machine by operating one of the first powered wire feeding device and second powered wire feeding device;

(d) automatically making a spring coil having a desired coil diameter and a first coil stiffness with the one wire; and (e) iterating steps (b) through (d) for others of the first and second pairs of wires to make spring coils of the desired coil diameters and coil stiffnesses from wires having different wire diameters.

3. The method of claim 2 comprising automatically adjusting the spring coiling machine as a function of a wire diameter of the one of the first and second pairs of wires.

4. An apparatus for making mattress and upholstery springs from wires of at least two different diameters comprising:

a first wire feeding device;

a second wire feeding device;

first and second wire feeding motors connected to the first wire feeding device and the second wire feeding device, respectively;

a first wire guide disposed adjacent an input side of the first wire feeding device and simultaneously supporting first and second wires;

a first movable carriage supporting the first wire guide;

a first carriage actuator connected to the first movable carriage and operable to move the first wire guide between a first position aligning the first wire with the first wire feeding device and a second position aligning the second wire with the first wire feeding device;

a second wire guide disposed adjacent an input side of the second wire feeding device and simultaneously supporting third and fourth wires;

a second movable carriage supporting the second wire guide;

a second carnage actuator connected to the second movable carriage and operable to move the second wire guide between a first position aligning the third wire with the second wire feeding device and a second position aligning the fourth wire with the second wire feeding device;

a third wire guide comprising first and second wire paths intersecting at a single outlet path and disposed adjacent output sides of the first wire feeding device and the second wire feeding device, the first wire path directing one of the first and second wires from the first wire feeding device to the single outlet path, and the second wire path directing one of the third and fourth wires from the second wire feeding device to the single outlet path;

spring coiling machine disposed adjacent the third wire guide and receiving one of the first, second, third and fourth wires from the single outlet path, the spring coiling machine having a motor controlling a device for bending wire and an actuator controlling a device for cutting wire; and a programmable control connected to the first and second wire feeding motors, the first carriage actuator, the second carriage actuator, the motor and actuator on the spring coiling machine.

5. The apparatus of claim 4 further comprising a plurality of sets of wire straightening rollers rotatably mounted to each of the first movable carriage and the second movable carriage, each of the sets of wire straightening rollers adapted to straighten one of the wires prior to the one of the wires entering a respective one of the first wire guide and the second wire guide.

6. A multiple wire feeder for feeding first, second, third and fourth wires of at least two different diameters to a spring coiling machine making mattress and upholstery springs, the multiple wire feeder comprising:

a powered first wire feeding device having an input side and an output side;

a first wire guide comprising first and second wire paths disposed on the input side of the first wire feeding device and simultaneously supporting respectively the first and second wires;

a first movable carriage supporting the first wire guide;

a first actuator connected to the first movable carriage and operable to move the first wire guide between a first position aligning the first wire oath with the first wire feeding device and a second position aligning the second wire path with the first wire feeding device;

a powered second wire feeding device having an input side and an output side;

a second wire guide comprising third and fourth wire paths disposed on the input side of the second wire feeding device and simultaneously supporting respectively the third and fourth wires;

a second movable carriage supporting the second wire guide;

a second actuator connected to the second movable carriage and operable to move the first wire guide between a first position aligning the third wire path with the second wire feeding device and a second position aligning the fourth wire path with the second wire feeding device;

a third wire guide comprising fifth and sixth wire paths intersecting at a single outlet path and disposed on respective output sides of the first and second wire feeding devices, the fifth wire path adapted to direct a wire from the first wire feeding device, along the single outlet path to the spring coiling machine, and the sixth wire path adapted to direct a wire from the second wire feeding device, along the single outlet path to the spring coiling machine, whereby any one of four wires is selectively fed from the wire feeder to the spring coiling machine.

7. The apparatus of claim 6 wherein each of the first wire feeding device and the second wire feeding device further comprises a first roller and an adjacent second roller adapted to receive therebetween one of the wires from a respective one of the first wire guide and the second wire guide.

8. The apparatus of claim 7 further comprising a pressure actuator operatively connected to the second roller, the second roller being movable by the pressure actuator toward and away from the first roller to apply a desired pressure on the one of the wires between the first roller and the second roller.

9. The multiple wire feeder of claim 6 wherein the first and second wire paths are adapted to support wires having different first and second wire diameters.

10. The multiple wire feeder of claim 9 wherein the third and fourth wire paths are adapted to support wires having different third and fourth wire diameters.

11. The multiple wire feeder of claim 10 wherein the fifth wire path is adapted to support wires of the first and second wire diameters and the sixth wire path is adapted to support wires of the third and fourth wire diameters.

12. A method of feeding multiple wires to a spring coiling machine making mattress and upholstery springs comprising:

(a) providing a first pair of wires simultaneously on a first wire guide adjacent an inlet of a first powered wire feeding device and a second pair of wires simultaneously on a second wire guide adjacent an inlet of a second powered wire feeding device, each of the first and second pairs of wires having a different wire diameter;

(b) automatically moving one of the first and second wire guides to align one wire of the first and second pairs of wires with an inlet of one of the first and second powered wire feeding devices;

(c) automatically feeding the one wire through a third wire guide disposed adjacent respective output sides of the first cowered wire feeding device and the second powered wire feeding device and into a spring coiling machine by operating one of the first powered wire feeding device and second powered wire feeding device, so that a spring coil having a desired coil diameter and a first coil stiffness can be made from the one wire; and (d) iterating steps (b) and (c) for others of the first and second pairs of wires to make spring coils of desired coil diameters and different coil stiffnesses from wires having different wire diameters.

* * * * *

UNITED STATES PATENT AND TRADEMARK OFFICE

CERTIFICATE OF CORRECTION

PATENT NO. : 6,910,360 B2
DATED : June 28, 2005
INVENTOR(S) : Stjepan Hresc et al.

It is certified that error appears in the above-identified patent and that said Letters Patent is hereby corrected as shown below:

Column 2,
Line 63, “FIG. 2 is perspective view” should read -- FIG. 2 is a perspective view --.

Column 3,
Line 15, “machine to which the multiple wire feed apparatus of FIG.” should read -- machine with which the multiple wire feed apparatus of FIG. --.
Line 51, “FIG. 3, Each” should read -- FIG. 3, each --.

Column 4,
Line 33, “grooves 80,82 that having” should read -- grooves 80, 82 having --.

Column 6,
Line 6, “the head, waist and leg section are” should read -- the head, waist and leg sections are --.
Line 10, “the wire used is” should read -- the wire used are --.
Line 13, “is also input” should read -- are also input --.
Line 16, “either, a particular type of mattress or,” should read -- either a particular type of mattress or --.
Line 45, “in order make lighter” should read -- in order to make lighter --.

Column 8,
Line 22, “FIG. 7., the motor” should read -- FIG. 7, the motor --.
Line 23, “motor 74ato stop.” should read -- motor 74a to stop --.
Line 36, “operates the active feed motor” should read -- operate the active feed motor --.

Column 9,
Line 31, “the PLC 154 can be electrically to either” should read -- the PLC 154 can be electrically connected to either --.
Lines 66-67, “the third wire guide and” should read -- the third wire guide; and --.

Column 11,
Line 41, “first wire oath with” should read -- first wire path with --.

UNITED STATES PATENT AND TRADEMARK OFFICE

CERTIFICATE OF CORRECTION

PATENT NO. : 6,910,360 B2
DATED : June 28, 2005
INVENTOR(S) : Stjepan Hresc et al.

It is certified that error appears in the above-identified patent and that said Letters Patent is hereby corrected as shown below:

Column 12,
Line 48, “the first cowered wire” should read -- the first powered wire --.

Signed and Sealed this

Fourteenth Day of February, 2006

JON W. DUDAS
*Director of the United States Patent and Trademark Office*

UNITED STATES PATENT AND TRADEMARK OFFICE
Certificate

Patent No. 6,910,360 B2 Patented: June 28, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Stjepan Hresc, Prelog, (HR); Josip Gecic, Koprivnica, (HR); and Branko Duras, Varazdinske Toplice, (HR).

Signed and Sealed this Sixth Day of November 2007.

DERRIS H. BANKS
*Supervisory Patent Examiner*
Art Unit 3725